United States Patent [19]

Williams et al.

[11] 4,308,709

[45] Jan. 5, 1982

[54] APPARATUS FOR FORMING PAPER BOXES AND THE LIKE

[76] Inventors: Donald F. Williams, 15 W. Mason St., Santa Barbara, Calif. 93102; Charles L. Phy, Rte. 2, Box 143, McEwen, Tenn. 37101

[21] Appl. No.: 116,899

[22] Filed: Jan. 30, 1980

Related U.S. Application Data

[62] Division of Ser. No. 786,955, Apr. 12, 1977, Pat. No. 4,194,441.

[51] Int. Cl.[3] ..... B65B 11/20

[52] U.S. Cl. ..... 53/207; 53/462; 53/578; 493/177

[58] Field of Search ..... 93/51 HW, 51 M, 51 R, 93/49 M, 49 R; 53/579, 578, 563, 566, 574, 206, 207, 462; 493/177

[56] References Cited

U.S. PATENT DOCUMENTS

| | | | |
|---|---|---|---|
| 2,605,598 | 8/1952 | MacKenzie | 53/207 |
| 2,885,842 | 5/1959 | Boitel | 53/462 |
| 3,064,405 | 11/1962 | Gentry | 53/579 |
| 3,411,264 | 11/1968 | Farquhar | 53/462 X |
| 3,771,282 | 11/1973 | Flanagan | 53/207 X |
| 3,941,037 | 3/1976 | Reichert | 53/563 X |
| 3,965,804 | 6/1976 | Elford | 93/51 HW |
| 3,995,539 | 12/1976 | Wallin et al. | 93/51 HW |
| 4,159,609 | 7/1979 | Focke | 53/462 X |
| 4,196,563 | 4/1980 | Gabrielson et al. | 53/579 X |

FOREIGN PATENT DOCUMENTS

| | | | |
|---|---|---|---|
| 546926 | 10/1959 | Belgium | 53/207 |

*Primary Examiner*—James F. Coan
*Attorney, Agent, or Firm*—Wm. Jacquet Gribble

[57] ABSTRACT

A box blank with receptacle and cover sections each with side and end flaps has a hinge panel joining the sections. A vacuum pickup draws a flat blank from a stack to a feed carriage which delivers the glue coated blank to a former and a forming head having concave and convex interacting pressure plates which maintain doubled over end flaps of each section in concave configuration while the folded end sections are adhered to form a box tray. Former flap benders cooperate with the tray forming head to shape the tray. A second vacuum pickup clasps the formed tray at the hinge panel and draws it from the forming head into engagement with folding elements such that cover and receptacle sections are bent together along the hinge panel to form a closed box.

The machine implementing the process is cam and lever motivated with a gluer for forming the folded end flaps and holding the box partially closed after the tray is formed for loading articles into the box before it is closed. A feed carriage moves a blank from the supply stack past a gluer to the path of a movable forming head which progresses vertically to traverse a former with the blank. Both forming head and former have flap benders for forming the blank into a tray, including movable plates for stressing the flaps and for supporting the tray. A second vacuum pickup draws the formed tray from the former and engages it with crimpers and ramps for closing the box. A loading station is included in the machine.

2 Claims, 26 Drawing Figures

FIG. 10.
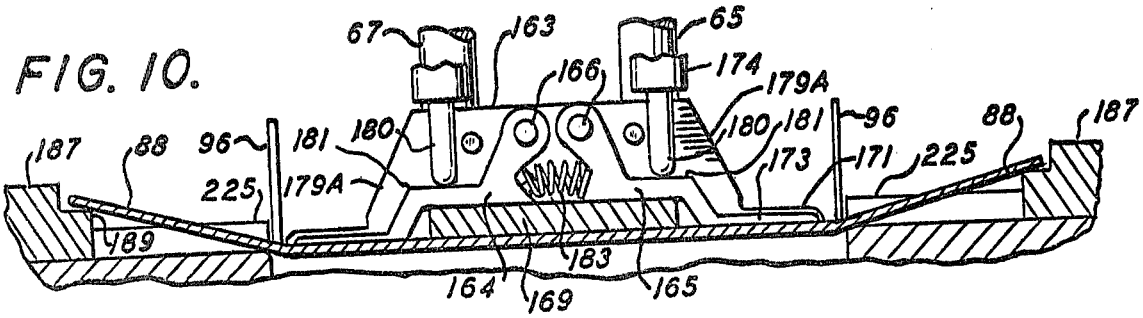
FIG. 9.
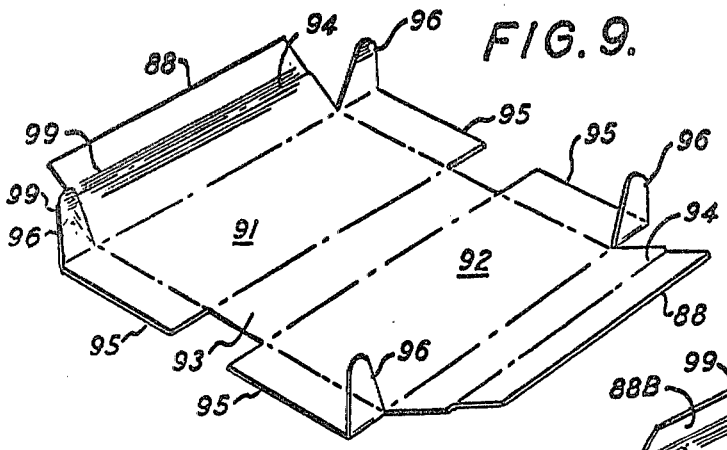
FIG. 13.
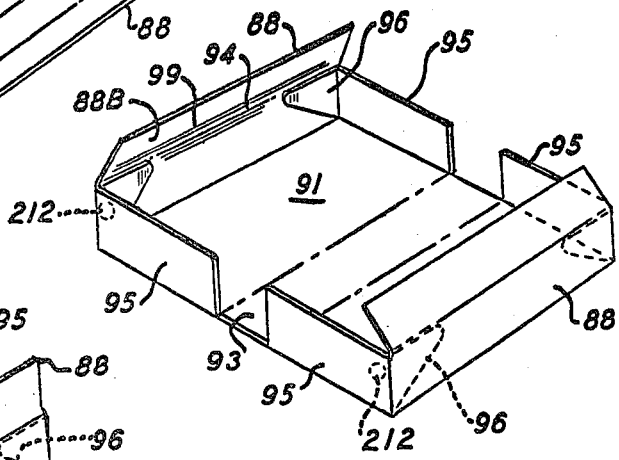
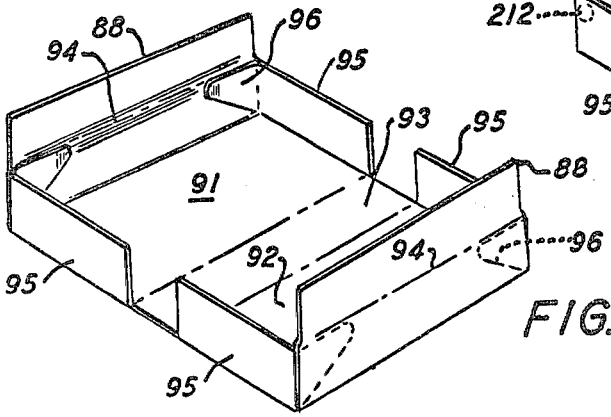
FIG. 11.
FIG. 12.
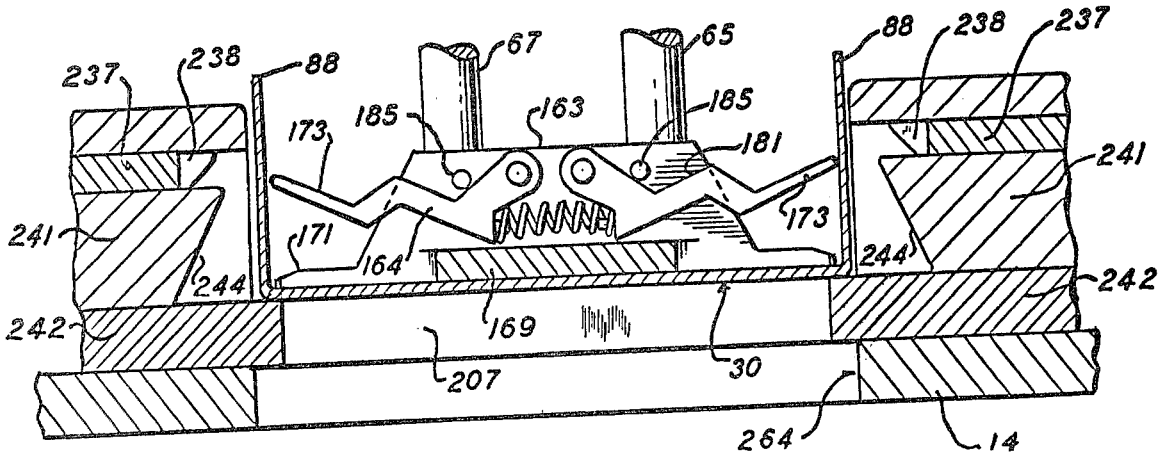

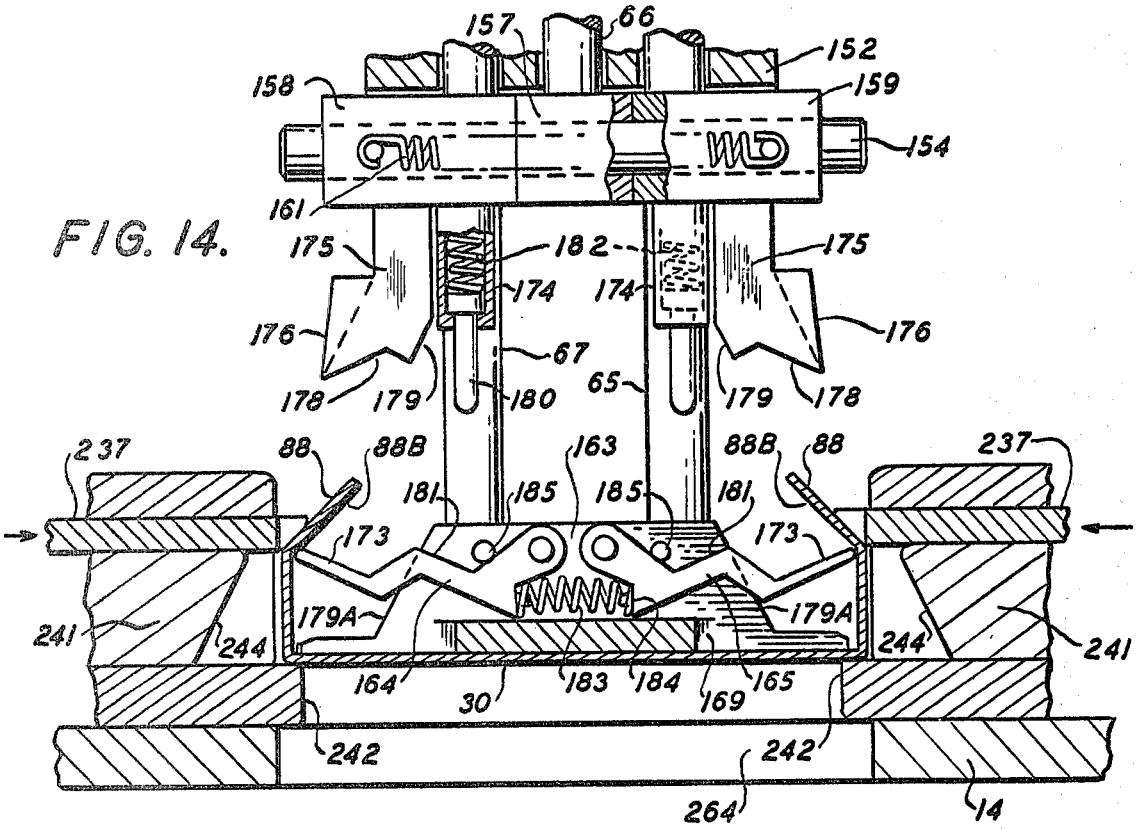
FIG. 14.
FIG. 15.
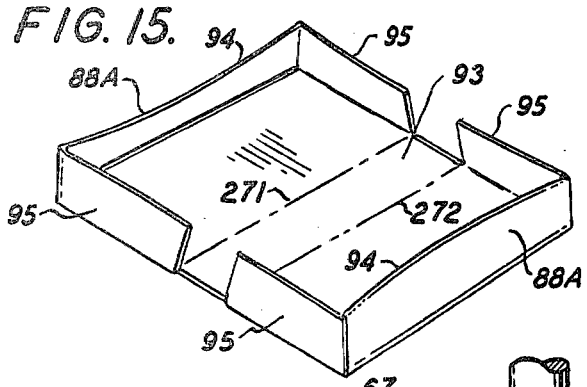
FIG. 17.
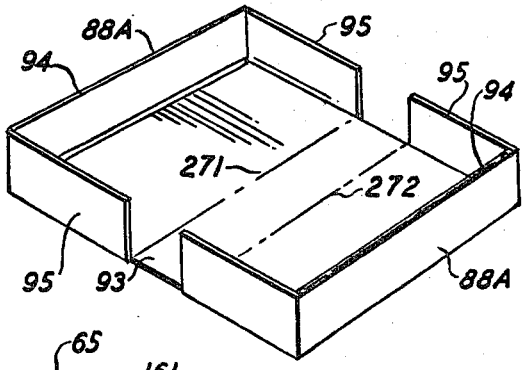
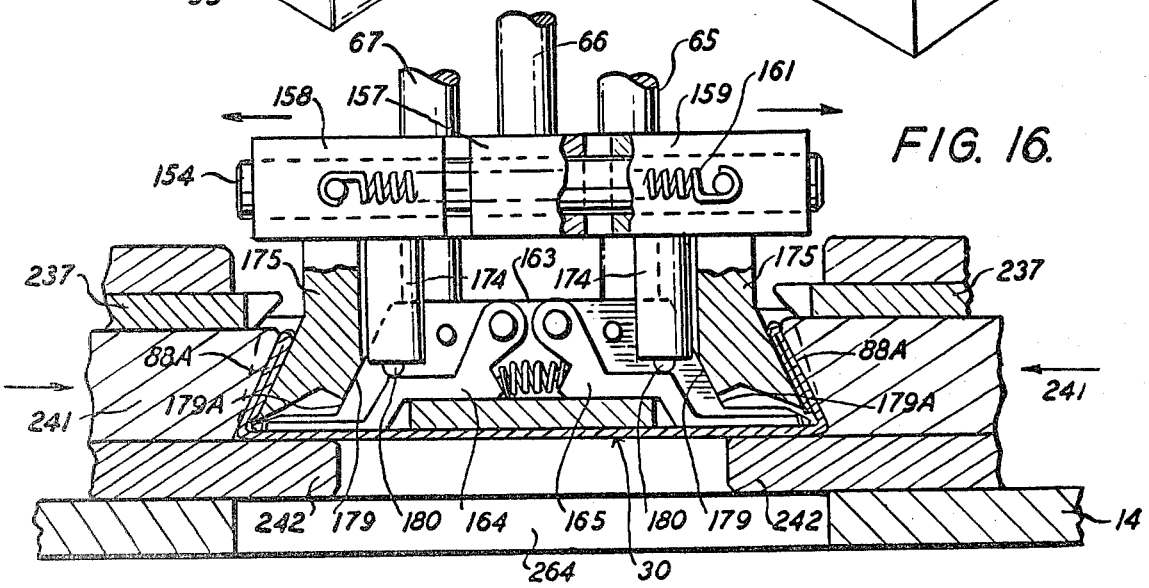
FIG. 16.

FIG. 18.
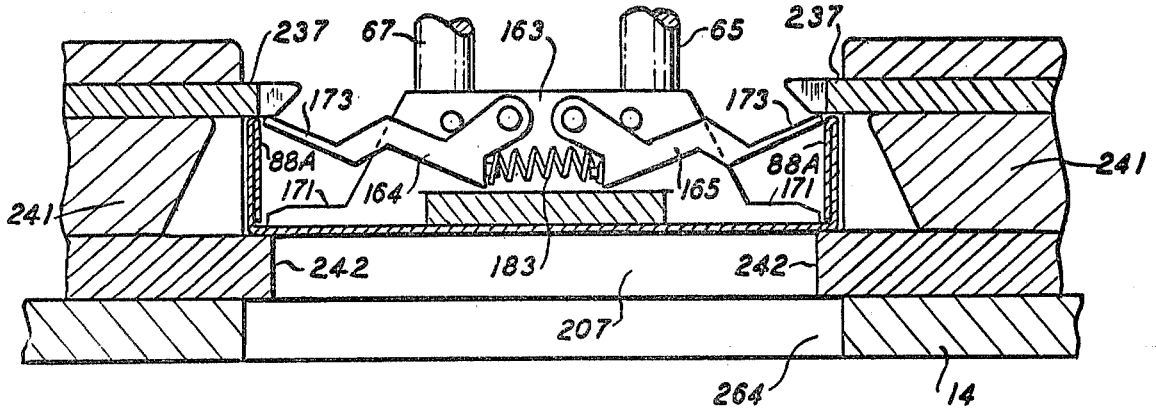
FIG. 19.
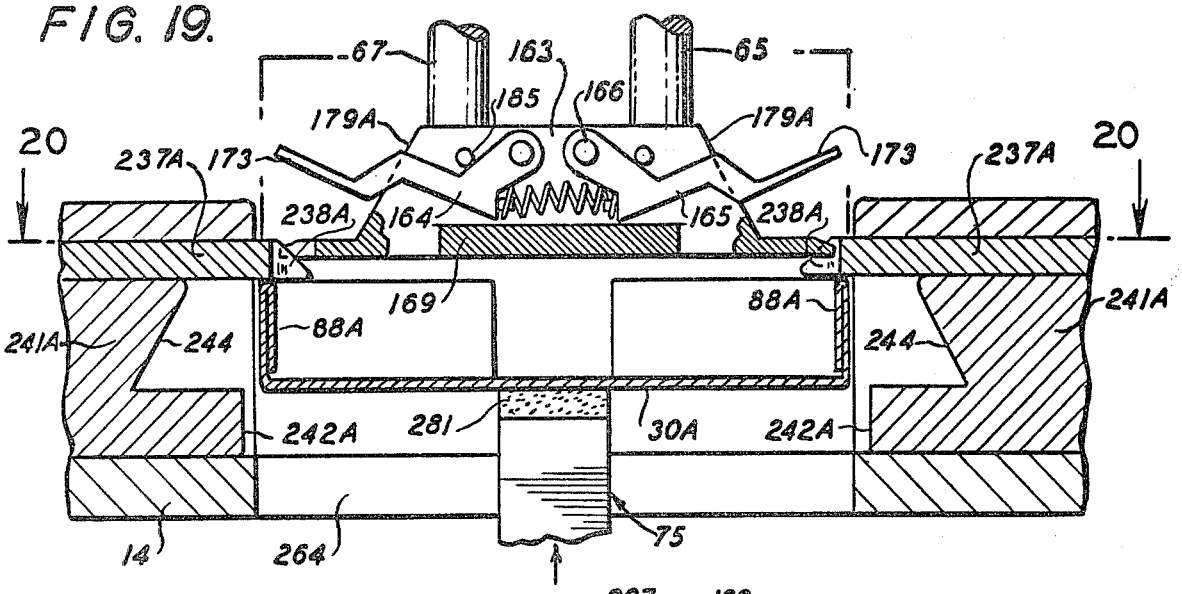
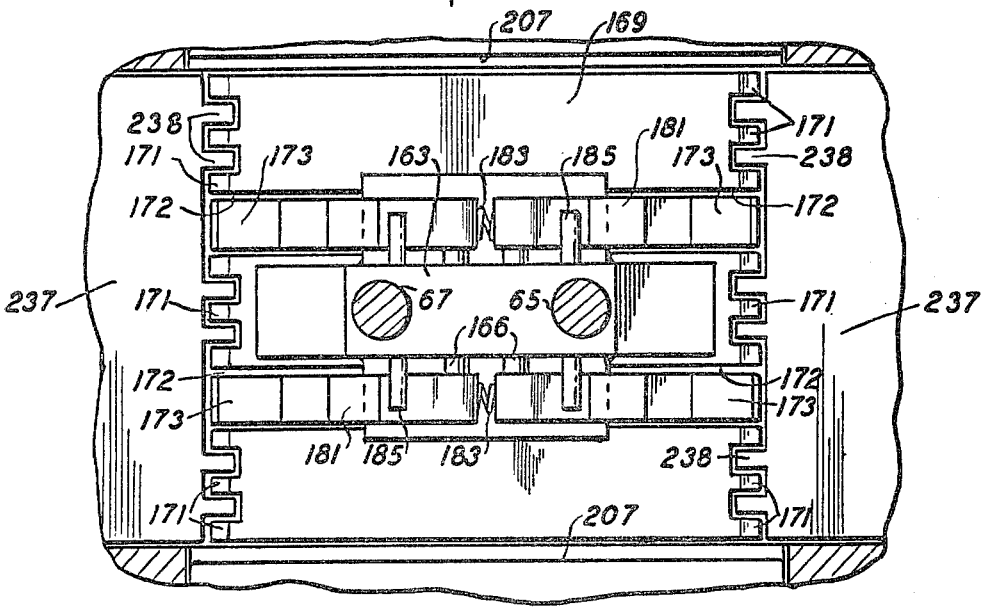
FIG. 20.

FIG. 22.
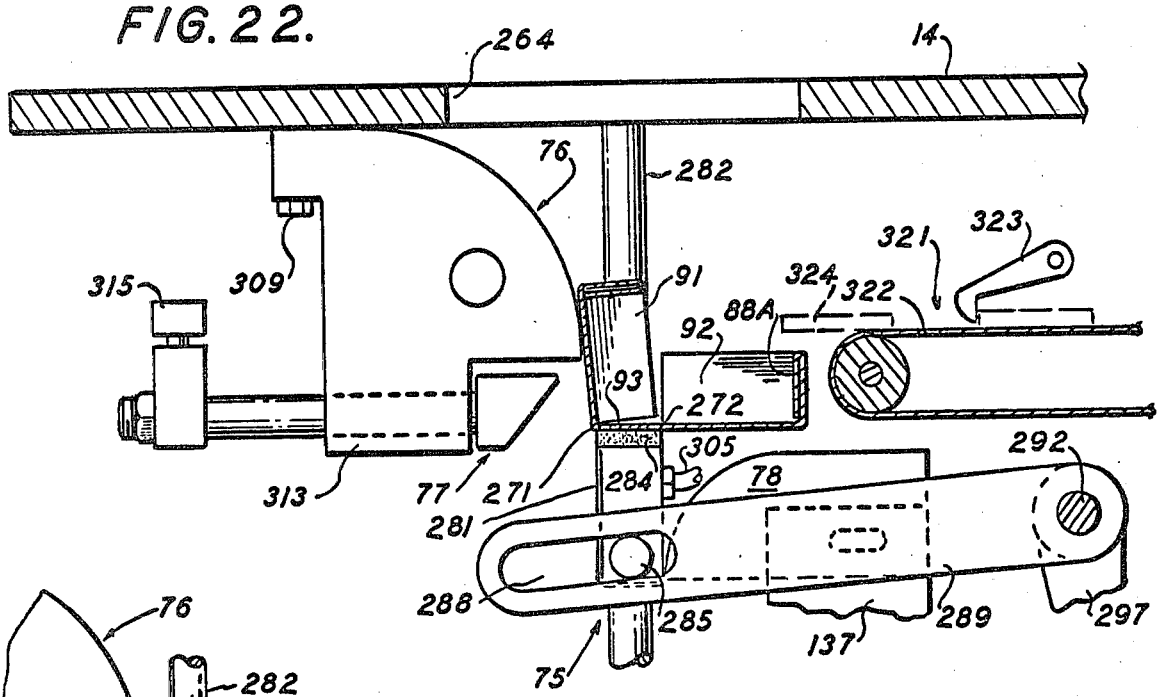
FIG. 24.
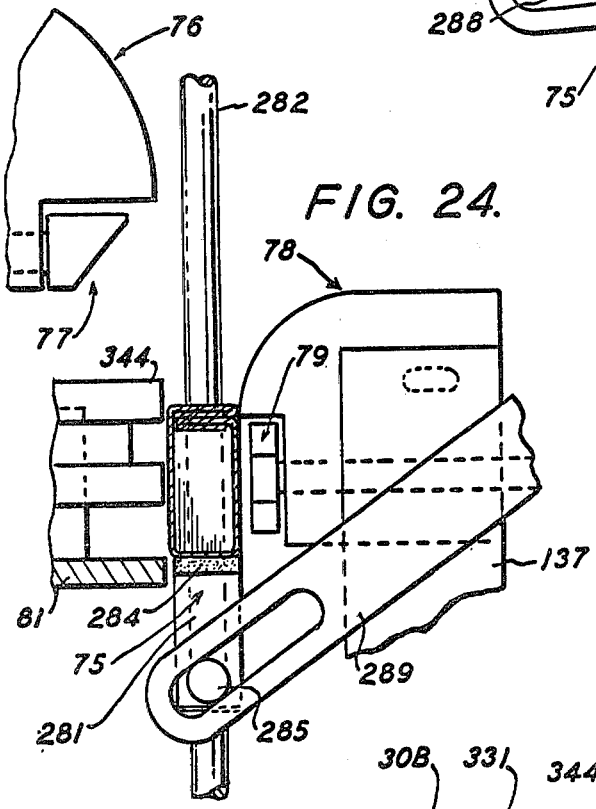
FIG. 23.
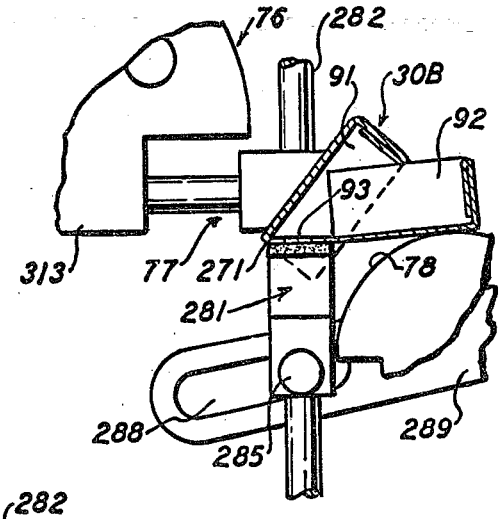
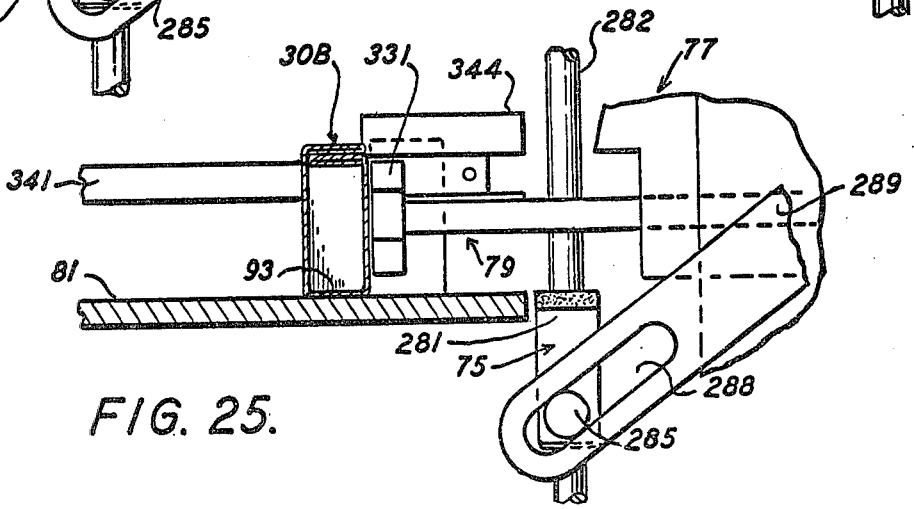
FIG. 25.

APPARATUS FOR FORMING PAPER BOXES AND THE LIKE

RELATED APPLICATIONS

This application is a division of our pending application Ser. No. 786,955 filed Apr. 12, 1977, now U.S. Pat. No. 4,194,441.

BACKGROUND OF THE INVENTION

The invention relates to method and apparatus for stressing laminated pieces to achieve a straight line resultant piece with thin laminar stock by balancing the laminating stress against the inherent stress in the fold of the material. Particularly, the method and apparatus of the invention is related to folded trays and one piece folding boxes made from pre-cut box blanks. A preliminary examination of prior art has developed the following U.S. Pat. Nos.: 1,899,652, Stortz, Feb. 28, 1933; 1,959,235, Goss, May 15, 1945; 1,962,638, Czerweny, June 12, 1934; 1,979,993, Peck, Nov. 6, 1934; 2,469,641, Goss, May 10, 1949; 2,808,766, Larsen, Oct. 8, 1957; 2,863,370, Dorfman, Dec. 9, 1958, 2,957,395, Meyer, Oct. 25, 1960; 3,101,653, Burden, Aug. 27, 1963; 3,459,105, Waldbauer, Aug. 5, 1969; 3,521,536, Waldbauer, et al, July 21, 1970; 3,584,548, Brown, June 15, 1971; 3,913,465, Keck, Oct. 21, 1975.

The process of the invention affords a method whereby box blanks of many materials may be formed into a shell or tray and further provides steps whereby the tray may be folded into a closed one-piece box. The method provides an interval during closing wherein goods may be loaded into the box. The process is distinctive with respect to prior art in applying pressure to both sides of doubled or tucked end flaps to achieve a stressed condition during adhesion which balances the stress in the box blank material adjoining the score lines of the end flaps such that the tucked end flaps approach a straight line and right angle configuration at the fold line to form a neater box appearance and to aid closure. In addition the process provides a step wherein the formed tray stage is grasped at the hinge panel to be drawn through the box closing stages and affords dwell time for loading the box before closure.

The preferred apparatus for implementing the process is in part distinct from said prior art in being comprised of a forming assembly with forming plates having converging concave and convex pressure segments for stressing the tucked end flaps of the box blank during the adhering stage of the end flaps, and in further comprising vacuum means adapted to grasp the tray hinge panel for tray separation from the forming assembly and moving the formed tray format of the blank through box closing elements.

SUMMARY OF THE INVENTION

The process of the invention for making boxes contemplates the fabrication of a laminar structure including the steps of fabricating laminar blanks, making adhesive the sections of the blank to be joined, overlapping the blank portions to be joined, imposing a varied curvature on the tucked or overlapped sections from both sides thereof and maintaining the curved relationship until the adhesive sets. The process also includes the steps of erecting the other sides to form a tray and the removal of the formed tray from the forming elements.

Preferably the bottom of the tray is supported during the erecting steps.

In the instance of the fabrication of the one-piece folded box, the process contemplates the further steps after forming a shallow tray from the box blank by erecting the side flaps of the blank, of applying glue to the flaps to be joined, tucking in the joining flaps and imposing varying curvature on the tucked flaps, maintaining tucked and curved relationship of the flaps until the adhesive sets, grasping the formed tray at the hinge panel thereof, and stripping the thus formed shallow tray from the forming head and converging the receptacle and cover sections together while grasped at the hinge panel.

The invention contemplates apparatus for performing the inventive method which comprises a box blank supply rack, means for moving a single blank from the rack to forming position at a forming head, the forming head being adapted for reciprocating motion across the delivery path of the box blank. The apparatus also comprises a former matrix for erecting and joining the side and end flaps of the box blank at the forming head, means for applying adhesive to the flaps, means for tucking and adhering the end flaps into overlapped configuration, and pressure means adapted to conform the tucked end flaps into a curved configuration with respect to the fold line thereof. There is means for removing the box blank in tray configuration from the former matrix, including vacuum means for grasping the tray at the hinge panel, means for travelling the vacuum head, and forming elements on the path of the vacuum head adapted to converge the cover and receptacle sections of the box.

A preferred embodiment of the machine implementing the process of the invention has timing cams to operate levers to move the pressure means into and out of contact with the tucked end flaps. Sprocket and chain drives, geared linkage and other positive motion mechanical apparatus is preferred to synchronize rigidly the movements of the various portions of the machine of the invention. The cams may be adjustable to facilitate adaptation of the machine to various box forms and sizes. These and other advantages of the invention are apparent from the following detailed description and drawing.

BRIEF DESCRIPTION OF THE DRAWING

FIG. 9 is a perspective view of a box blank partly through the forming process;

FIG. 10 is a fragmentary sectional elevation showing the association of the apparatus to the partially formed box blank of FIG. 9;

FIG. 11 is a perspective view of a partially formed box blank after further steps of the process;

FIG. 12 is a fragmentary sectional elevation of the apparatus showing the association of the apparatus to the further formed box blank of FIG. 11;

FIG. 13 is a perspective view of a successive stage of box formation;

FIG. 14 is a fragmentary sectional elevation showing the association of the apparatus to the imposition of the box configuration of FIG. 13;

FIG. 15 illustrates in perspective a further processing of the box showing the concave position of the end panels;

FIG. 16 associates the processed box of FIG. 15 and the apparatus;

FIG. 17 illustrates in perspective a tray in accordance with the process from a box blank;

FIG. 18 is a sectional elevational view associating the apparatus with the box tray of FIG. 17;

FIG. 19 illustrates an alternate embodiment of the apparatus at a point of the process when the formed box tray is ready to be removed from the matrix of the apparatus;

FIG. 20 is a fragmentary sectional plan view similar to a view taken along line 20—20 of FIG. 19;

FIG. 22 is a fragmentary transverse sectional elevation schematically showing the initial closing of the box tray of FIG. 17 at the loading station and the apparatus attendant thereto;

FIG. 23 illustrates schematically overfolding the box cover to achieve the conditioning of the hinge line in the hinge section of the box;

FIG. 24 illustrates schematically in sectional elevation the final closing of the box;

FIG. 25 illustrates in schematic section the ejection of the closed box from the forming machine.

Figure 1:
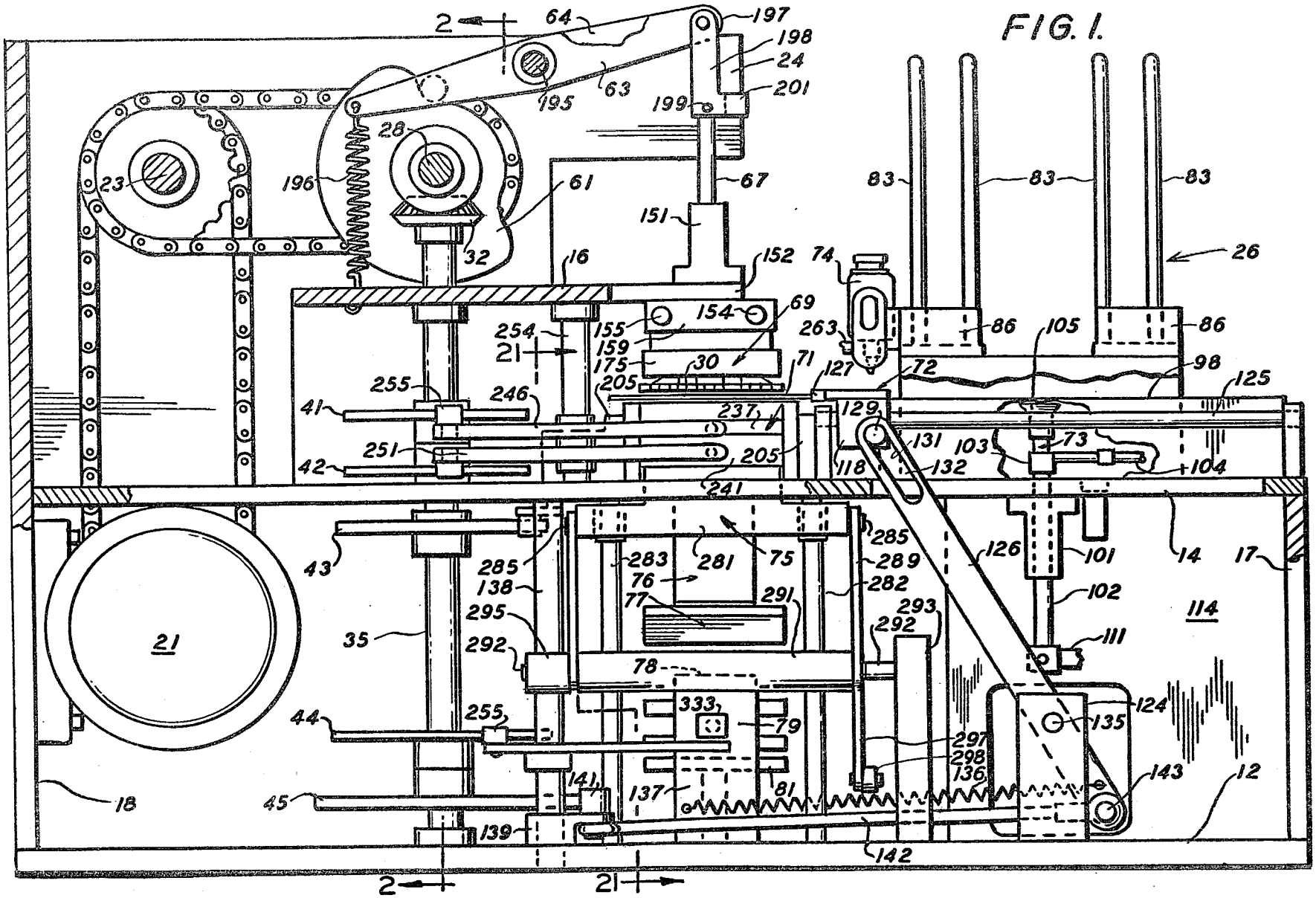
FIG. 1 is a schematic side elevation of the apparatus of the invention.

In the various Figures like numerals are used to designate like parts. The illustrative box is a "turnover" type, but the invention does not preclude practice of the process to achieve a tray without doubled, or turned over, end flaps. The drawing is largely schematic, thicknesses being sometimes exaggerated to aid understanding of the inventive process and the apparatus.

DESCRIPTION OF THE PREFERRED EMBODIMENT

The process of the invention can be better understood with respect to the apparatus adapted to perform the process. The apparatus and the process are shown in the illustrative FIGS. 1 through 26. The apparatus is physically arranged in three vertically spaced tiers with a first support platform 12, a second support platform 14, and a third support platform 16. Support platform 16 is of smaller longitudinal extent than either the first or the second support platforms and extends transversely in the mid-area of the apparatus. End panels 17, 18 support the upper platforms. Lower platform 12 may rest upon a support surface or upon legs (not shown).

Although not shown, the sides are conventionally enclosed with transparant shields or wire netting to preclude accidental harm from the moving components of the apparatus. Similarly, in order to more clearly illustrate the invention, the conventional pneumatic and electrical power supplies, and the interlock system to preclude operation of the apparatus without the shield in place, are also not illustrated.

Figure 3:
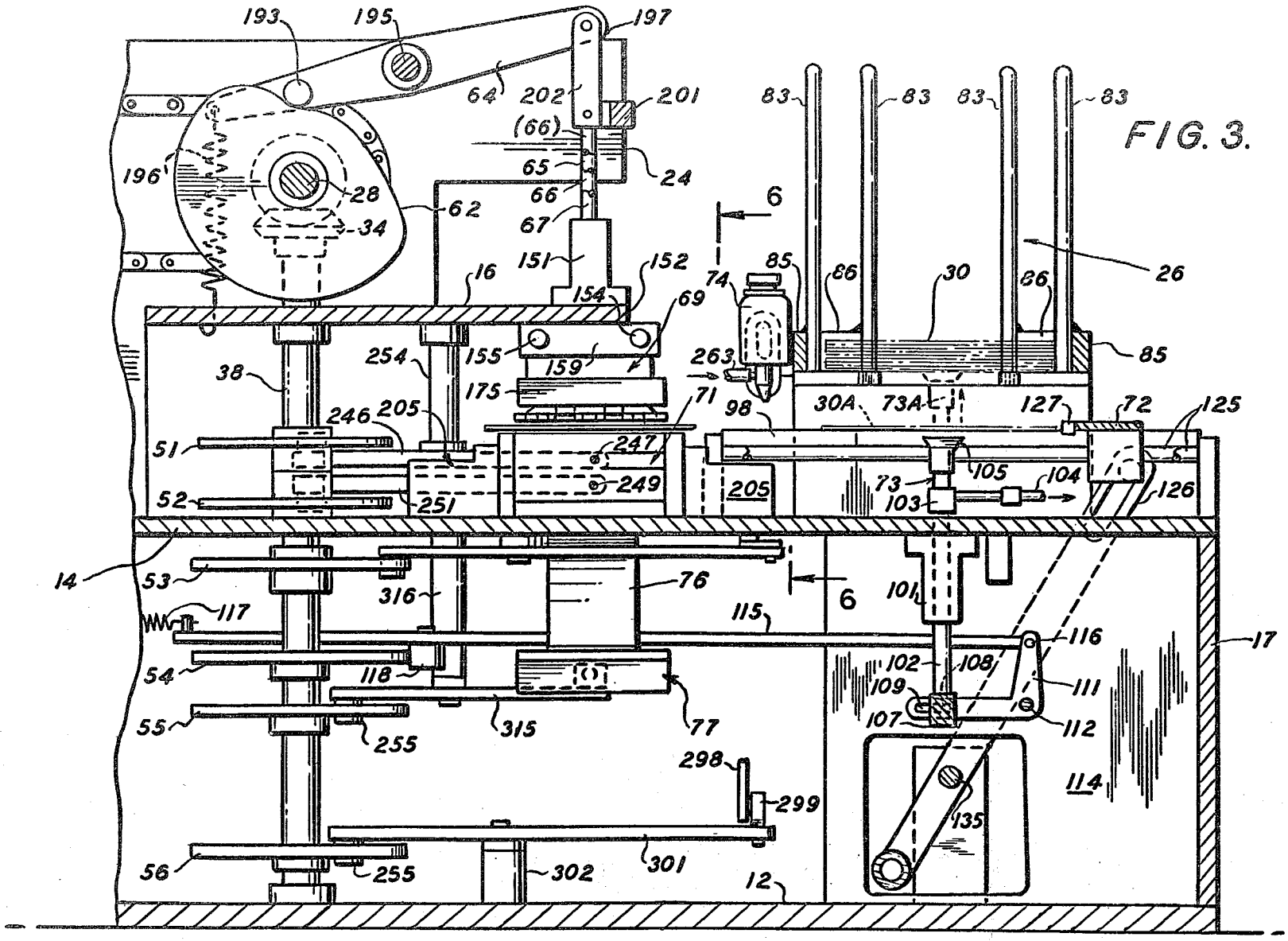
FIG. 3 is a longitudinal sectional elevation taken along line 3—3 of FIG. 2.

End panel 18 supports a side mounted electric motor 21, which drives a power shaft 23 journalled in side walls 24 which rise from support platform 14. The motor and the power shaft are at what will be regarded as the rearward end of the machine. The forward end of the machine, adjacent end panel 17, supports a supply stacker 26 which, as shown in FIG. 3, releaseably retains a vertical stack of flat box blanks similar to the blank 30 shown in FIG. 4.

A countershaft 28 also journalled in the sidewalls 24 is driven from power shaft 23 by conventional chain and sprocket linkage. Power transmission devices for speed changes such as gear reduction boxes etc., may be interposed between the motor and the power shaft or between the power shaft and the countershaft to achieve the desired power and speed output for the countershaft. Such arrangements are conventional and have not been illustrated herein. The invention also does not preclude the utilization of a vari-speed motor as a source of power. Spaced along the transverse extent of the countershaft are two oppositely faced miter gears 31,32. The miter gears or bevel gears mesh with matching gears 33, 34 respectively. Driven miter gear 33 is fixed to a vertical cam shaft 35 and miter gear 34 is fixed to a vertical cam shaft 38.

Vertically spaced from top to bottom of cam shaft 35 are various cams 41, 42, 43, 44, 45, each fixed to rotate with the cam shaft. Similarly cam shaft 38 has a plurality of cams 51, 52, 53, 54, 55, 56 spaced from top to bottom on the shaft.

Cams 41, 42 and 51, 52 are fixed to their respective cam shafts between platforms 14 and 16. The remaining cams are fixed to their respective cam shafts between platforms 12 and 14. The functions of the various cams are discussed later.

Transversely spaced cams 61, 62 on countershaft 28 impart varied motion to a pair of forwardly extending rocker arms 63, 64, respectively, which impart reciprocating motion to a plurality of vertical rods 65, 66, 67 which actuate various elements of a forming head 69. The forming head traverses vertically a matrix 71 (FIGS. 1 and 3) into which box blanks are presented by a blank carriage 72. Blanks are fed to the carriage by a vertically reciprocating vacuum feeder 73 which removes one blank at a time downwardly from the stack magazine 26 to the carriage 72. As the carriage feeds the blank rearwardly toward forming head 69 an adhesive pattern is applied to the blank by means of glue sprays 74 which are pneumatically powered and controlled. A vacuum head extractor 75 (FIG. 21) grasps the box tray at the hinge panel and removes it downwardly from the matrix where it is partially folded by ramp 76 and then held by means of the extraction head at an overfolding bender 77 at a loading position as shown in FIG. 22.

Final traverse of a closing ramp 78 closes the box and an ejection ram 79 impells the closed box onto an accumulating platform 81 from which the boxes are removed or further packaged.

Proceeding to a more detailed description of the apparatus, the stacking bin 26 is comprised of a plurality of vertical guide rods 83 the pattern of which depends upon the configuration of the box blank being processed. For the blank 30 of FIG. 4 rod position relative to the blank is indicated by dotted circles 83A in FIG. 4. The vertical rods are fixed to transverse rails 85, the rearwood rail of which supports a spaced pair of glue spray heads 74. Angles 86 extending longitudinally from the rails support the end pairs of rods which abut the end flaps 88 of the box blank.

Although the box is completely described in the previously mentioned patent application a brief description of the box will be given here to simplify the explanation of the process of the invention. The box blank is divided by fold lines into a cover portion 91 and a receptacle portion 92 connected by a hinge portion 93. The end flaps 88 of both the cover portion and the receptacle portion are further divisible along fold lines 94 so that they may be doubled when the box or tray is formed. Each of the receptacle and the cover portions has a side flap 95 on each edge thereof. On that end of the side flap remote from the hinge portion 93 there is a triangular tab 96. As can be seen from FIG. 5 the carriage 72 propels the box blank along tracks like track 98 of FIG. 3 beneath the spray heads 74 such that a continuous glue stripe 99 is applied to the end flaps along the division line 94 thereof and to the tips of the tabs 96.

A quick inspection of FIGS. 9, 11, and 13 shows that the adhesive is applied to the blank 30 such that the blank is held in the tray configuration of FIG. 17 by adhesive, with the end flap being doubled upon itself at each end along the fold line 94 of each end flap. The tabs maintain the erect orientation of the side flaps with respect to the cover and receptacle flaps.

To return to the progression of the box blank within the apparatus implementing the process the blank in the stacker 26 is removed from the stack to the tracks 98 by the suction head 73 previously mentioned. The feeder has a journal housing 101 in which a rod 102 reciprocates. A manifold 103 connected to a vacuum line 104 which is further connected to a vacuum source not shown, supports a pair of suction cups like the cup 105 of FIG. 3 which are transversely spaced along the manifold.

Reciprocating rod 102 terminates in a bar 107 with a transverse pin 108 shown in dotted lines in FIG. 3. The pin rides in an elongate slot 109 of an "L" shaped actuating arm 111, the arm pivoting about a pin 112 fixed in an inner wall 114 of the apparatus. A connecting rod 115 extends from front to rear of the apparatus from an actuating arm pivot pin 116 to an extension spring 117 tending to pull the rod 115 toward the rear of the apparatus and thus retain rod 102 at the bottom of its reciprocating path.

A cam contact roller 118 is secured in the rod such that its periphery contacts the surface of cam 54. As cam 54 rotates it displaces cam follower 118 and induces longitudinal motion in the rod 115 which in turn causes arcuate motion of actuating arm 111 thrusting rod 102 upwardly until the suction cups contact the lowest of the blanks 30 in the stacker 26. When the cam continues its progression about the center line of countershaft 38 the rod 102 and its suction cups are lowered withdrawing a blank from the stacker and placing it on the tracks 98 in contact with the carriage 72.

The tracks 98 lie within parallel horizontal carriage rails 125 upon which a pivot arm like arm 126 reciprocates carriage 72. The carriage has a pusher lip 127 which impels a blank 30 from the just withdrawn position of FIG. 3 along the tracks into the path of the forming head 69 as shown in FIG. 1.

Carriage 72 comprises the lip 127 extending between slider blocks 128 on each rail 125. A transverse thrust pin 129 extends outwardly from each slider block in contact with an inner wall 131 of a slot 132 in each pivot arm 126. Support posts 124 on each side of the vertical divider wall 114 support a journal 135 upon which pivot arms 126 move in arcuate fashion. As the arms move the carriage 72 is impelled rearwardly and forwardly along the rails 125 beneath the stack 26. An extension spring 136 (FIG. 1) is anchored at one end to one pivot arm below the journal 135 and at the other end to an upright block 137 such that the spring biases the carriage forwardly into loading position relative to the stack. Toward the rear of the apparatus are a pair of traversely spaced journal rods like the rod 138 of FIG. 1. A pivot arm 139 adjacent platform 12 carries a cam roller 141. The roller is in contact with cam 45 on cam shaft 35. A connector rod 142 extends between arm 139 and a pivot pin 143 at the bottom of pivot arm 126 remote from journal 135. Cam force on roller 141 causes arm 139 to move longitudinally of the apparatus, causing a reciprocating motion of connecting rod 142 which in turn pivots arm 126 above journal 135 moving the carriage backward and forward beneath the stack 26. As will be explained later with respect to the relative timing of all the cams, the cam shape of cam 45 is such that the carriage velocity increases as the blank moves toward the spray heads 74 and then remains constant as the blank passes beneath the spray heads and then decelerates to deposit the sprayed blank beneath the forming head 69 above the former matrix 71. The return carriage is under the urging of extension spring 136 and need only be timed with respect to the rise of the vacuum cups 105 to supply another blank from stack 26.

Journal 135 extends from side to side of the apparatus parallel to support panel 17 and a second arm similar in configuration and function to the arm 126 of FIG. 1 operates to reciprocate carriage 72 from the opposite side of stack 26. The tandem pivot arms are fixed to journal 135 and move in synchronism so that there is no wracking of the carriage 72 on its rails 125.

Figure 6:
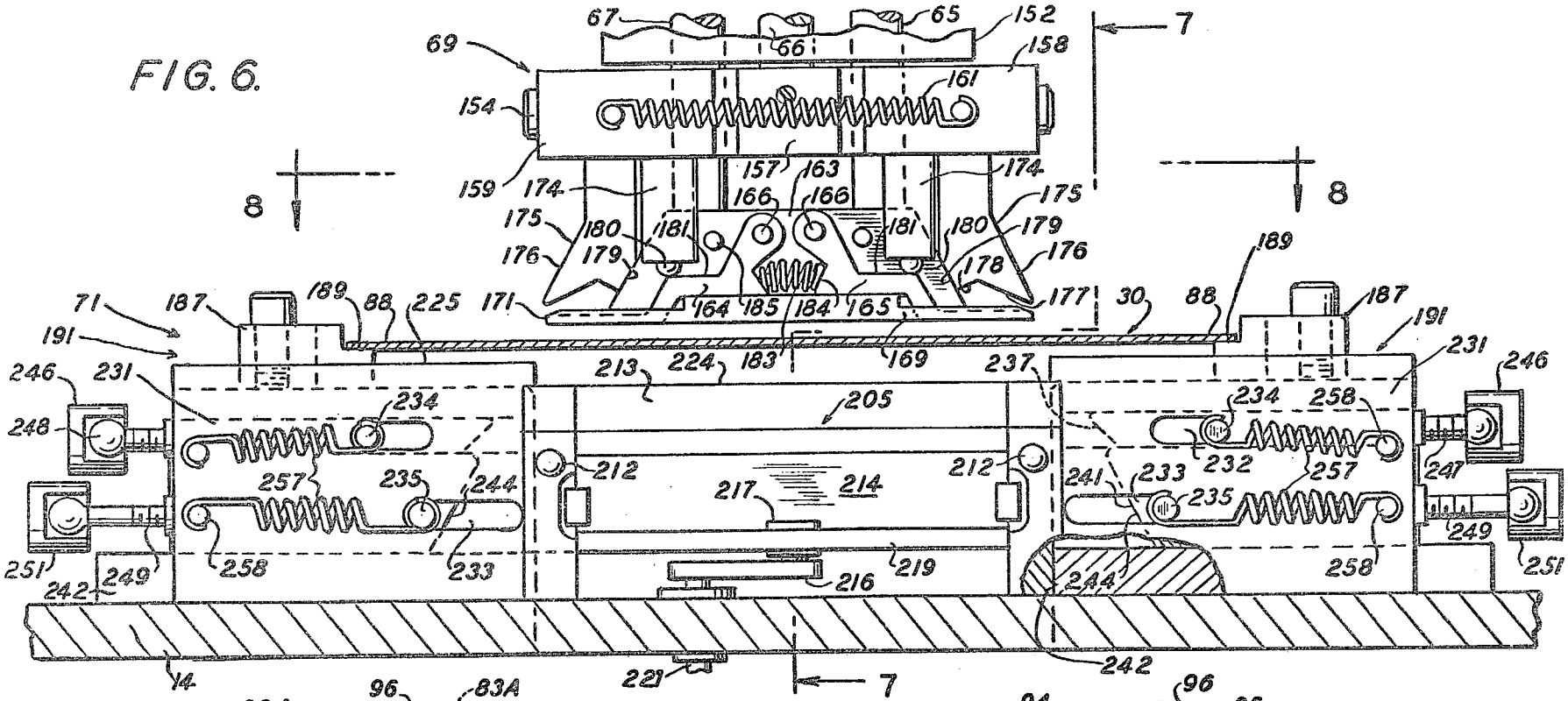
FIG. 6 is a fragmentary transverse sectional elevation taken along line 6—6 of FIG. 3.

The forming head and the matrix 69 and 71 respectively are best described preliminarily with respect to FIGS. 3 and 6. A journal post 151 fixed to a tongue 152 of tier platform 16 guides and journals the vertical rods 65,66,67 which reciprocate within the journal post and impart motion to the components of the forming head. Two transverse pins 154,155 hold in vertical relationship three forming head components: an inner brace block 157 and separated outer compression blocks 158,159. Brace block 157 is fixed to central vertical rod 66 and compression blocks 158,159 are biased by a compression spring 161 inwardly against the brace blocks 157, along pins 154,155 which extend through all three blocks.

Figure 8:
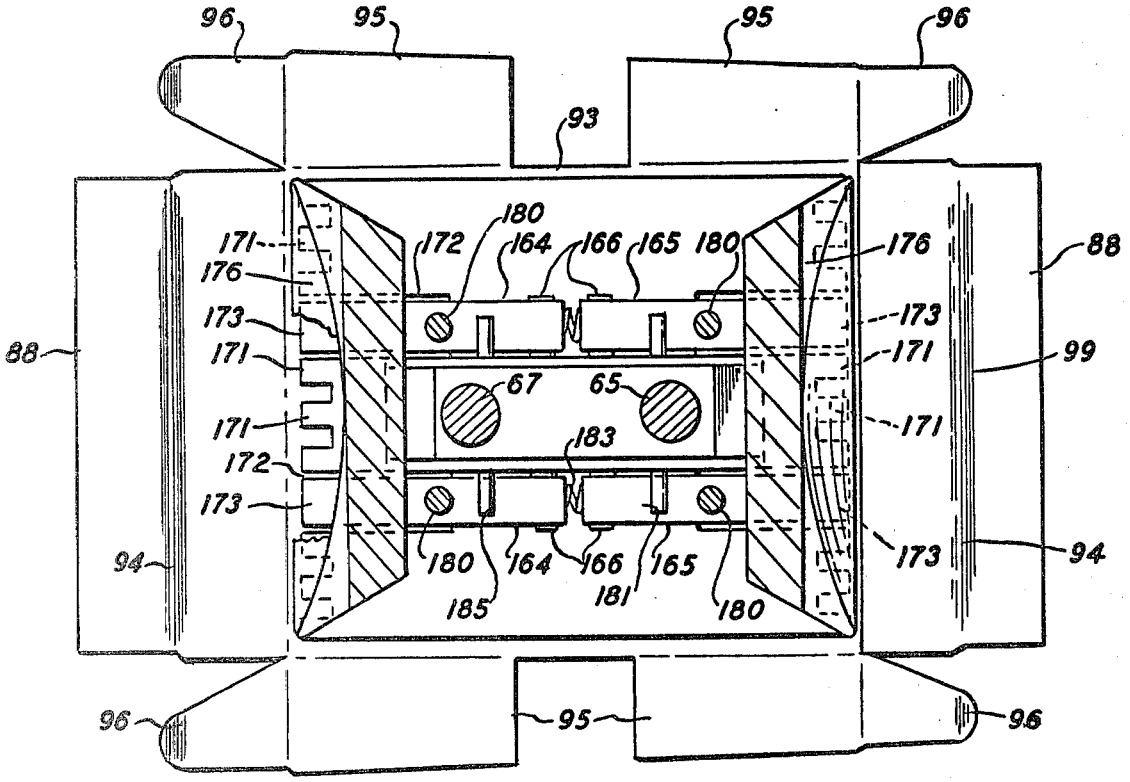
FIG. 8 is a plan section taken along line 8—8 of FIG. 6.

Vertical rods 65,67 are fixed at their lower ends at a pivot block 163 to which oppositely oriented brace levers 164,165 are arranged in pairs on longitudinally extending pivots 166 as may be seen from FIGS. 6 and 8. A bearing plate 169 with a plurality of spaced fingers 171 at each of its transverse edges is at the bottom of the pivot block. Wider slots 172 between fingers each receive an extending brace foot 173 of each brace lever.

From each of compression blocks, 158,159 two pin barrels 174 and a concave compressor 175 extend downwardly toward bearing plate 169. In addition to having a concave face 176 each compressor has a bottom cavity defined by upwardly converging planar surfaces 177, 178 which aid in the folding of the end flaps 88 along the fold lines 94 (see FIG. 4). A cam ramp 179 on each compressor 175 slope outwardly from the inner wall of the compressor, to engage to desce with a sloping cam surface 179A on each of the opposed longitudinal walls of the pivot block.

In FIG. 6 each of the brace levers 164, 165 is depressed by the pressure of spring loaded pins 180 against a knee 181 of each brace lever. Each pin barrel is bored to recess both the pin and its spring 182. Pin pressure overcomes the bias of a compression spring 183 secured between the inwardly facing flanks 184 of each pair of brace levers. When not impinged by a pin each spring 183 urges the brace levers against the pin stops 185 in pivot block 163 as shown in FIG. 18.

Adjustable side guides 187 support the end flaps 88 of the blank 30 on guide lips 189. The guides are secured each to the upper walls of one of transversely separated matrix housings 191 between which blank 30 is impelled by the downward thrust of bearing plate 169.

Figure 2:
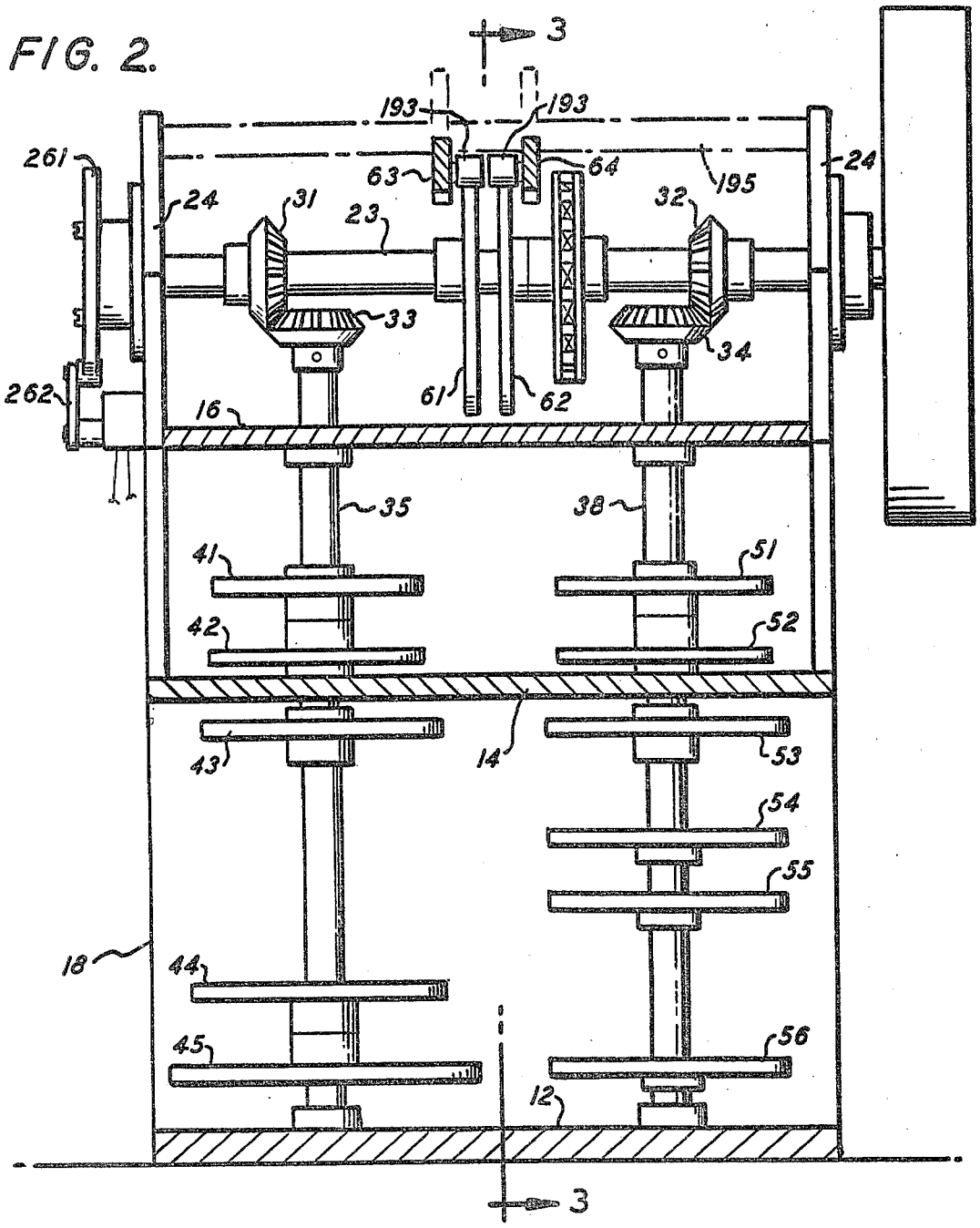
FIG. 2 is a fragmentary sectional elevation taken along line 2—2 of FIG. 1.

FIGS. 1, 2, and 3 illustrate the cam drive for the vertical rods 65,66, and 67 which impel the components of forming head 69. Countershaft 28 carries the two cams 61,62 which impinge upon a cam roller 193 on each of rocker arms 63,64.

Both rocker arms are journalled on a transverse shaft 195 and extend therefrom in both longitudinal directions. An extension spring 196 is fixed at the rearward end of each rocker arm and extends downwardly to tier platform 16 and is affixed to the platform to bias each cam roller 193 into contact with the respective cam surface of the two cams 61, 62. Each rocker arm has a forward end 197 and a connector pivotally suspended from the end. Arm 63 had a connector 198 in which vertical rod 67 is secured by a pivot axle 199. A yoke 201 extends transversely about a connector 202 a rocker arm 64 and is joined to vertical rod 65 such that rods 65 and 67 move in unison in response to the motion imparted to rocker arm 63 by cam 61. Vertical rod 66 operates in response to motion imposed by cam 62. While the cams rotate through 360° of arc in unison, their peripheral surfaces are differently contoured such that vertical rod 66 moves differently from the rods 65,67 for reasons to be explained later on.

In FIG. 6 the brace and compression blocks 157,158 and 159 are descending together, with each of the four pins 180 bearing on the knees of the brace levers such that the elements 173 thereof are co-planar with the pressure plate 169. Box blank 30 is supported on lips 189 of the guides 187 by the end flaps 88 of the blank.

Figure 7:
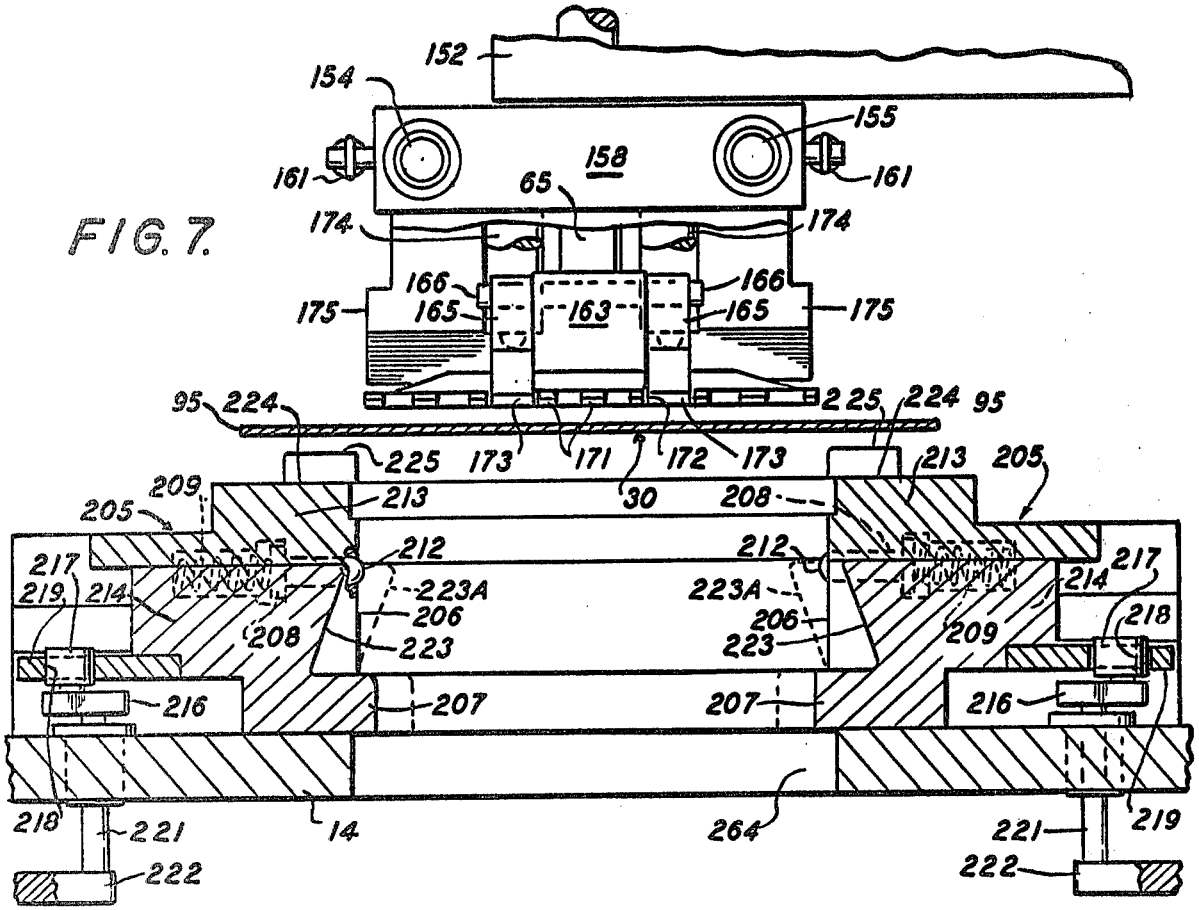
FIG. 7 is a fragmentary sectional elevation taken along staggered line 7—7 of FIG. 6, showing a box blank beneath a forming head.

The blank is suspended above matrix 71 which has a cavity defined by the matrix housings 191 (FIG. 6) and transverse wall blocks 205 seen partially in FIG. 1 and in section in FIG. 7. As can be seen from FIG. 7 the matrix cavity has inner walls 206 which are interrupted by a protruding ledge 207 on each side. The ledges are moveable within the wall blocks, as are headed pins 208 biased by compression springs 209 shown in dotted lines. The springs are headed pins 208 with protruding ends 212 are recessed in static portion 213 in each wall block. Ledge 207 is fixed to a moving portion 214 of the wall block. The ledges support the box blank when it is impelled into the matrix cavity by formng head 69 as shown in FIGS. 12 and 18. The ledges 207 are advanced and withdrawn by means of cranks 216 which have rollers 217 extending into slots 218 of a projection 219 of each portion 214. The cranks are moved by axles 221 fixed in arms 222 which are journalled in tier platform 14. The arms are impelled by contact with cams 43, 53 and the ledges are withdrawn to provide for removal of the formed tray from the matrix cavity.

The upper plateaus 224 of the wall blocks contact the side flaps 95 of the box blank as the blank descends into the matrix cavity, bending them erect with respect to receptacle and cover sections 91 and 92 of the blank. Bender strips 225 of matrix housings 191 force corner tabs 96 to bend with respect to flaps 95 to the position of FIG. 9. Each moving portion 214 has a crimping face 223 which is moved inward by the cam motivated arms 222 into the dotted position 223A of FIG. 7, in which position side flaps 95 of the blank are conformed to the overbent condition of FIG. 15.

Referring again to FIG. 6 it can be seen that matrix housings 191 are identical except that they are oppositely oriented. Each matrix housng has an end plate at each side like the end plates 231 of FIG. 6. Each end plate has vertically spaced elongate slots 232, 233 respectively in which stop pins 234,235 are moveable. The pins 234 protrude from folders 237 which has inwardly facing spaced teeth like teeth 238 of FIG. 12. The teeth match the spaces between teeth 171 of the bearing plate 169 (FIG. 20). The folders are moveable upon and with respect to pressure backup bars 241 which in turn are moveable with respect to support ledges 242. Each backup bar 241 has a convex face 244 complementary to the concave face 176 of compressor 175. The configuration of the concave face 176 is illustrated in part with respect to FIG. 8 wherein face 176 is seen to be arcuate at its upper edge and linear at its lower edge with uniform blending between the two lines of definition. The convex face 244 is complementary to the face 176 as previously stated.

Folder 237 on each side of the matrix cavity is linked to an actuating lever 246 by a spherically headed pin 247 which seats in a socket 248 in the lever arm. Similar spherically headed pins 249 extend from backup bars 241 and attach to lever arms 251 which actuate the transverse movement of the bars.

As can be seen from FIG. 1, the lever arms 246,251 on each side of the matrix are pivotally mounted in pairs to vertical axles 254 which are rearward between the matrix and the cam shafts 35 and 38. The lever arms 246 are engaged by cams 41 and 51 and the lever arms 251 are engaged by the cams 42,52. Conventional cam follower rollers 255 establish the association between the lever arms and the cam surfaces. Pairs of extension springs 257 on each end plate 231 act to load the rollers into cam contact by exerting an outward force on the folders and the backup bars which not only tends to move the folders and bars outwardly but also loads the lever arms about axles 254 and against the cams. Each spring extends from a pin 234 or 235 which is fixed in a folder or bar to a fixed pin 258 extending longitudinally from each of the four end plates 231.

TRAY FORMING OPERATION

The progression of box blank 30 through the tray forming operation will not be discussed, beginning with particular reference to FIGS. 1, 3, and 6. Carriage 72 is shown in FIG. 3 in blank receiving position beneath the magazine or stack 26. Reciprocating vacuum feeder 73, is urged by link 115, which is in contact with cam 54, upperwardly into the position 73A of FIG. 3 and the solid position 73 of FIG. 1. The vacuum cups 105 impinge upon the bottom surface of the bottom-most blank 30. A conventionally induced vacuum communicated to the cup by a linkage 104 from a vacuum source (not shown) attaches the blank to the assembly 73. As cam 54 continues to turn the resistance of spring 117 reasserts itself on link 115 and the vacuum feeder 73 retracts, bringing a blank 30 into the position shown at 30A in FIG. 3 on tracks 98, in position to be contacted by the pusher lip 127 of carriage 72.

Figure 5:
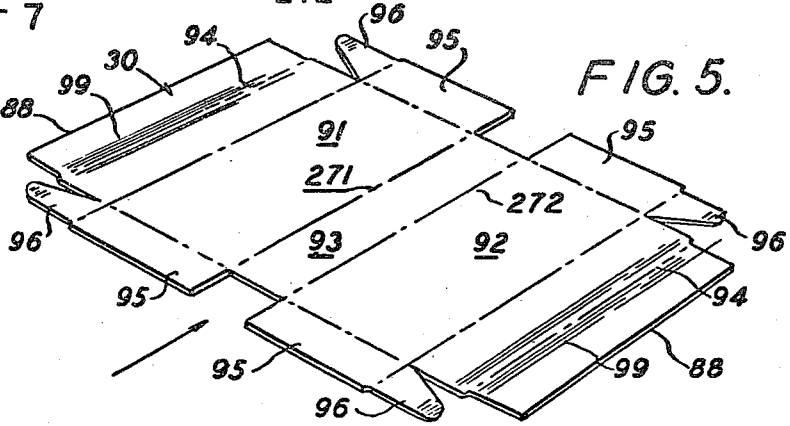
FIG. 5 is a perspective view of the box blank of FIG. 4, showing the pattern of adhesive applied thereto.
Figure 4:
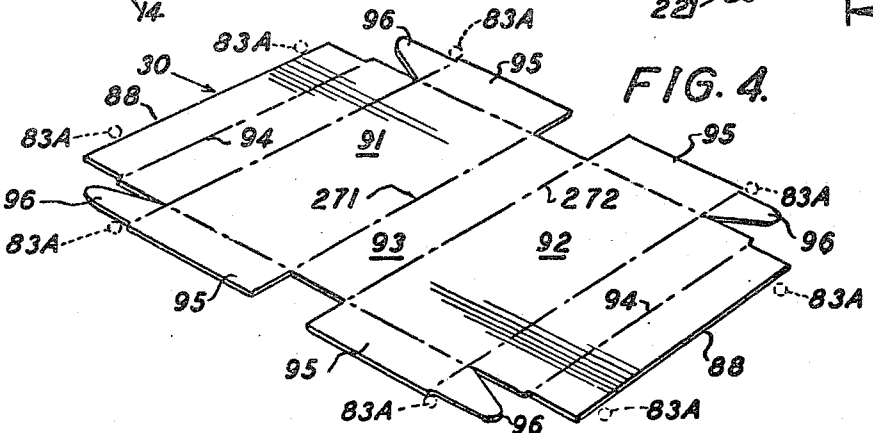
FIG. 4 is a perspective view of a flat box blank adapted to the practice of the invention.

Cams 45, 56 actuate connector rods 142 of pivot arms 126 to pivot carriage 72 rearwardly along rails 125 into the position of FIG. 1 wherein a blank 30 rests upon the lips 189 of guides 187 as shown in FIG. 6 and FIG. 1. As indicated in FIG. 5 by the direction arrow, the carriage accepts and moves the blank such that the side flaps 95 progress rearwardly first. In the progress of the carriage the blank is first accelerated and then reaches a constant speed as it passes beneath glue spray heads 74 for the application of adhesive stripes 99 on end flaps 88 and tabs 96.

The glue spray heads are conventional and conventionally operated from a timing cam such as the arcuately adjustable cam 261 shown fixed to the end of countershaft 28 in FIG. 2. The timing cam for the glue heads trips a switch 262 which actuates a solenoid valve (not shown) which opens the spray heads to apply the stripe to the blank.

The spray heads are preferably connected to the conventional cold glue distribution system in which a reservoir is pressurized continuously such that only the actuation of the solenoid valve is needed for cold glue to be delivered to lines 263 at the spray heads to apply the adhesive. Such a system is exemplified by the system sold under the trade name "Valco" which includes a cold glue pressure pot connected to an air tank and electrical controls for the glue spray system. Since this system is conventional it is not more fully described. Because the switch control cam 261 turns in unison with countershaft 28 there is synchronism between the spray head actuation and the performance of the rest of the apparatus of the invention.

As the box blank reaches the position of FIGS. 1 and 6 the cams 61, 62 actuate the rocker arms 63, 64 and impel forming head 69 downwardly such that the bearing plate 169 impinges upon the blank, pressing it into the cavity of matrix 71. The relative position of the bearing plate 169 periphery with respect to the positioned box blank is shown in FIG. 8.

As the blank begins its descent the brace feet 173 of the brace levers 164, 165 are in wide slots 172, co-planar with the fingers 171 of the bearing plate (FIG. 10). Relative movement of flap and stepped guides 187 imposes a bending movement on the end flaps 88 and the plateaus 225 inter-act to erect the tabs 96 with respect to the side flaps 95. This position is shown in both FIGS. 9 and 10. As the bearing plate and the rest of the forming head continue their downward descent into the matrix the box assumes the configuration of FIG. 11 which is related to the apparatus in FIG. 12. At this stage the box blank comes to rest upon ledges 207, above a central cavity in plate 14. Cams 61 and 62 cause a differen in elevation of the pivot block 163 from the blocks 157, 158 such that the brace levers are relieved of the pressure of pins 180 and attain the tilted attitude of FIG. 12 under the urging of springs 183. Brace lever positioning is assured by stop pins 185 in the pivot block 163.

As can be seen from FIG. 14 the bearing plate, under the urging of vertical rods 65,67, is at the bottom of its stroke wherea the blocks 157 through 159 are vertically separated therefrom. At this stage folders 237, impelled by the cam induced motion of lever arms 246, move inwardly against the outer portions 88A of the end flaps, bending them about line 94. Brace levers 164,165 on each side of the pivot block 163 establish a bend line and support a vertical portion of the flaps 88 such that the bend takes place at the proper line.

While this is being done, pin ends 212 (FIG. 7) assert themselves against corner tabs 96 to insure they achieve a square corner in combining with the end flaps 88. Thus, during the descent of the box blank to rest upon the ledges 207 and 242 of the matrix the side flaps, end flaps and corner tabs are all erected with respect to the receptacle and cover portions 91, 92 such that the blank attains a tray configuration, as shown in FIG. 15.

As the operation progresses, blocks 157 through 159 descend under the urging of rod 66, which is controlled by cam 62, until the concave compressors 175 descend upon the canted end flap portion 88B such that the converging under surfaces 177, 178 of the compressors aid in folding the portions 88B downwardly about the corner tabs 96 which are being maintained in position by the spring loaded pins 208.

As the blocks descend to bring compressors 175 to bottom position, pins 180 impinge upon the brace levers and return them to co-planar position with respect to the bearing plate, which is integral with the pivot block. Concurrently, lever arms 251, under the urging of cams 42 and 52, urge backup bars 241 into contact with the now doubled flaps 88A, impinging complementary surfaces 24 and 176 upon the doubled flaps to impose the concave configuration of the doubled flap shown in FIG. 15. Also, under the urging of cams 43 and 53, cranks 216 impel crimpers 223 against the side flap into the overbent position obvious to FIG. 15 where the box is shown erected. Surface 176 is indented to allow for tab thickness at 96A. The timing of this operation is critical, keyed to the sett time of the adhesive or cold glue. Once the process has achieved the imposition of the contoured configuration upon the doubled end flaps, sufficient dwell time must elapse for the adhesive to set and for stress forces to be established in the doubled flap bond so that when the compression forces of the bar and compressor on each flap is removed the box achieves the straight and erect configuration of FIG. 17. Pressure is developed between compressors 175 and backup bars 241 as the compressor cam surface 179 of each compressor descends one of the cam slopes 179A on the pivot block.

Preferably the spherical headed pins 249 are adjustable with respect to the levers 251 (FIG. 6) such that the pressure is adjustable to the optimum design. In this pressure position blocks 158, 159 are separated along rods 154 from the central block 157 as seen in both FIGS. 6 and 16. However, pivot block 163 and the compressors 175 present a solid mass to resist the forces imposed by backup bars 241 from both sides.

After the proper dwell time for the adhesive to bond, backup bars 241 are withdrawn as the lever arms 251 are contacted by a different portion of the cam surface. Springs 257 (FIG. 6) assert themselves and cause withdrawal of the backup bars to allow the doubled end flaps 88A to assume their erect position as in FIGS. 17 and 18. Cam 62 also signals the upward movement of the blocks 157, 158, 159 and withdrawal of compressors 175 from the matrix. Note that in FIG. 19, the alternate embodiment, the folders 237 with inverted teeth 238A, remain in place, (unlike the backup bars 241A and the ledges 207) being controlled by lever arms 246 which are in contact with contoured cams 42,52. The inverted teeth present more friction to upward box movement, but the two folders still permit upward withdrawal of the bearing plate 169 but strip the box 30B now in tray configuration, from the bearing plate. Extractor assembly 75 now reciprocates upwardly and is vacuum head 281 attaches itself to the hinge portion of the formed tray.

The transverse wall block ledges 207 seen in FIG. 7 are normal withdrawn to clear the path for the withdrawal of the formed tray through platform cavity 264.

Depending upon whether or not the tray is the desired end product the embodiment of FIG. 18 or the embodiment of FIG. 19 is utilized. In FIG. 18 the matrix housing ledges 242 are stationary and their projection inwardly of the edges of cavity 264 begins the folding operation of the tray along the hinge lines 271,272 of the erected tray (FIG. 17). However, should the tray be the desired end product then the ledges 242A of pressure bars 241A are formed integrally with pressure bars and are withdrawn therewith as seen in the embodiment of FIG. 19, clearing the way for extraction of the formed tray 30B through the cavity 264 in tier platform 14 without the tray being bent or partially closed.

STRUCTURE OF THE EXTRACTOR

An extractor suction head 281 at the top of extractor 75 (FIGS. 1 and 21 through 25) reciprocates vertically upon vertical cylindrical rods 282,283. The head has a resilient elongate collar 284 to contact the box hinge panel. A thrust pin like pin 285 extends longitudinally from each end of vacuum head 281. The thrust pins are impinged upon by the opposed walls 286,287 of elongate slots 288 in each of longitudinally spaced actuating arms 289 which are held separated by a longitudinal bar 291. Pivot pins 292 extend from each actuating arm at their juncture with the separating bar. At the forward end one pin 292 is journalled in a support post 293 which rises from floor platform 12 of the apparatus. A pillow block 295 supported from previously described journal rod 138 accepts the opposite pin 292.

A lever 297 fixed to forward actuating arm 289 at its juncture with bar 291 has a pivoted rigid link 298 which is in turn joined by a clevis 299 (FIG. 3) to a cam arm 301 which is journalled on a rising stub 302 intermediate cam 56 (on shaft 38) and the lever 297. A conventional cam 255 roller links the arm 301 to the cam surface.

Figure 21:
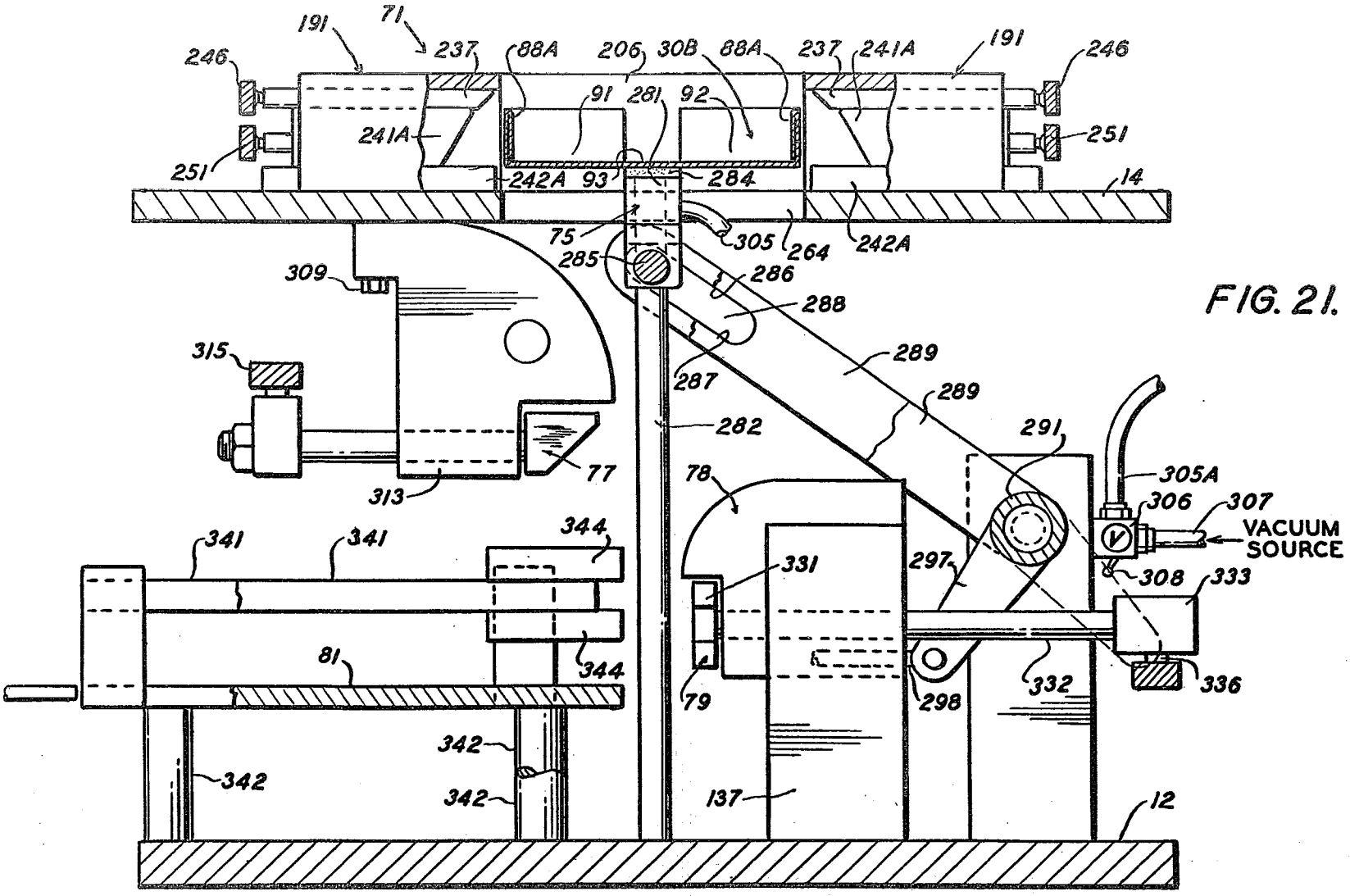
FIG. 21 is a transverse sectional elevation taken along staggered line 21—21 of FIG. 1.
Figure 26:
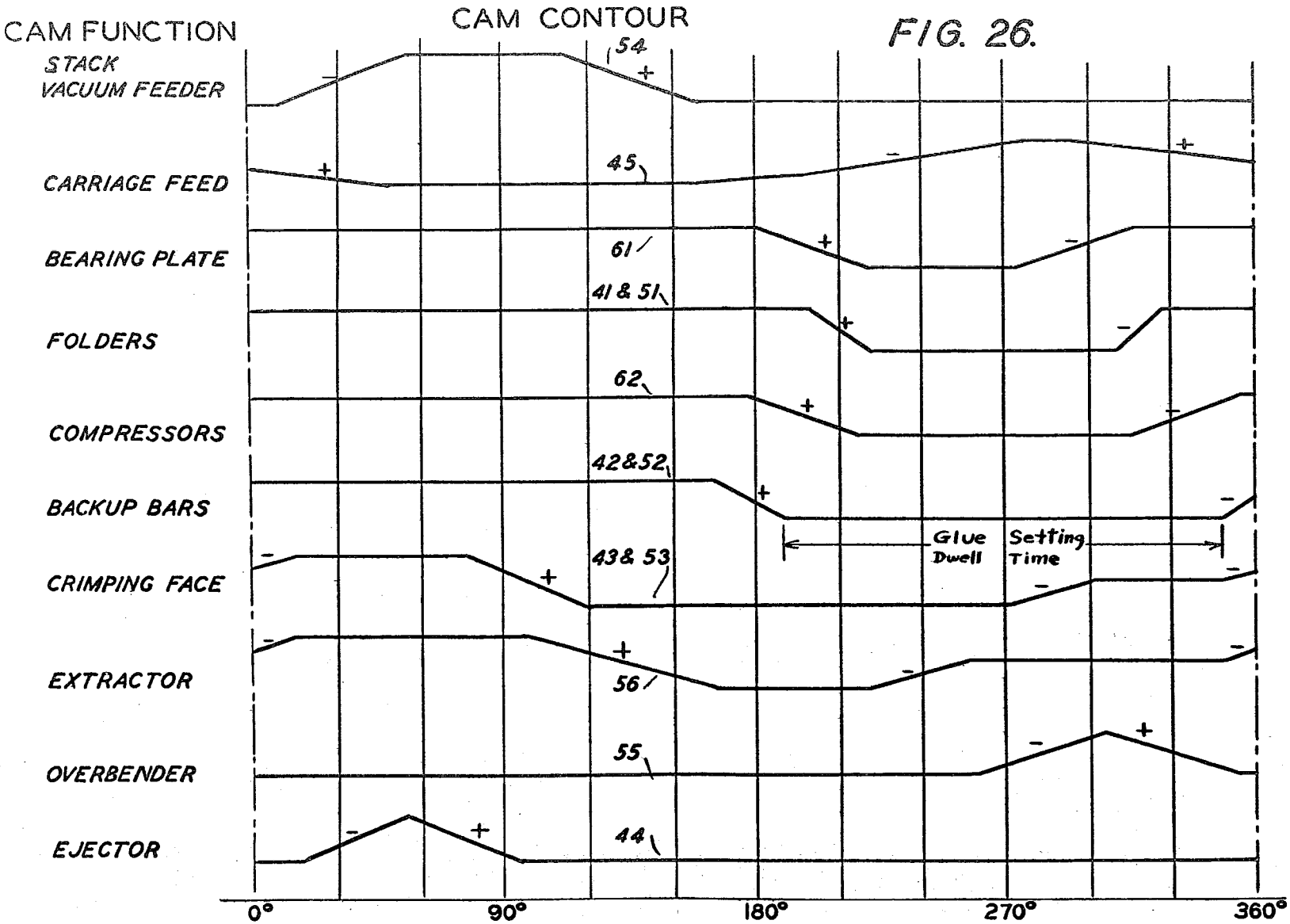
FIG. 26 illustrates by associated time lines the cam phases for the various functions of the machine elements.

The vacuum head 281 has one or more vacuum hoses 305 such as that visible in FIG. 21 connecting the head to a vacuum pump (not shown). In that Figure one end 305A of such a hose is seen connecting to a normally open valve 306 in series with a vacuum supply line 307. A toggle type valve lever 308 is positioned to be tripped by lever 297 in its arcuate path as the vacuum head descends, to loose the box from the head by breaking the vacuum.

The cam-induced arcuate horizontal motion of arm 301 imparts rotating movement to lever 297 about pivots 292, causing vertical arcuate motion of actuating arms 289 and thus reciprocating the vacuum head along rods 282,283. Conventional lost motion arrangements are employed in this linkage to compensate for arcuate movements.

As is evident from FIG. 21 the vertical path of the vacuum head is between the centrally opposed first ramp 76 and closing ramp 78. Ramp 76 is supported from tier platform 14 by conventional means such as screw 309.

As is also evident from the drawing, ramp 76 has a curvilinear box-contacting surface which converges toward the center line of motion of the vacuum head. As the box tray is extracted from the matrix by the vacuum head the cover portion 91 is folded with respect to hinge panel 93 along the hinge line 271 while the receptacle portion 92 remains unfolded along its hinge line 272 (see FIG. 22). The partly folded tray 30B is next acted upon by an overfolding bender 77 which reciprocates in a tang 313 of ramp 76 of the apparatus under the urging of a swing arm 315 pivotally suspended from a depending support 316 (FIG. 3) and contacting cam 55 by means of a conventional cam roller 255. The action of the overfolding bender 77 is seen in FIG. 23, where cover portion 91 is bent along hinge line 271 past the point necessary to form a right angle in order to overcome inherent springback which would interfere with the box remaining closed.

If desired a loading station 321 may be positioned as shown in FIG. 22, to take advantage of the dwell time (see FIG. 26) necessary for the overfolding of the cover with respect to hinge line 271. The loading station may comprise a conventional constant speed conveyor 322 with a box detainer 323 which cooperate to spill a load 324 into each receptacle 92 as the folding box pauses for the overbending procedure. Since cam 56 is already contoured to cause a pause in the downward reciprocation of vacuum head 281 at this point (see FIG. 26) no adjustment to the timing of the mechanism is necessary to accomplish the loading process.

After overfolding bender 77 withdraws, vacuum head 281 resumes its downward path, bringing the receptacle portion of the folding box into contact with closing ramp 78. Ramp 78 curves downwardly and inwardly toward the path of the vacuum head and is supported upon previously described upright block 137 rising from platform 12. Contact of the box with closing ramp 78 bends the receptacle portion along hinge line 272 to close the box into the configuration shown in FIG. 24.

During the downward progression of the vacuum head the vacuum forces holds the box hinge panel 93 securely to the vacuum head collar 284 such that bending may be accomplished with respect to the hinge panel.

Closing ramp 78 and upright block 137 also mount an ejection ram 79, previously referred to with respect to FIG. 21. The ejection ram has a pressure head 331 on a pressure rod 332 which reciprocates transversely in the block and ramp 78. A connector 333 outboard of the block is linked to a pivot arm 334 (FIG. 1) which is pivoted about journal rod 138 and extends beyond the rod rearwardly to contact cam 44 by means of cam roller 255. Preferably pivot arm 334 is slotted at its connection by pin 336 to connector 333 to accommodate the arcuate motion relative to the straight path of reciprocation of the ejection ram.

When the downward descent of the extractor 75 reaches the point shown in FIG. 25 the contour of cam 44 causes pivot arm 334 to stress the ejection ram against the receptacle portion of the closed box. At this point the vacuum is terminated in vacuum head 281 to release the box for delivery to platform 81. There boxes may accumulate on the platform between side guides 341. The platform itself is supported upon a plurality of posts 342 which extend above platform 12. Entry grippers 344 on each side of the platform assure proper retention of the ejected boxes.

The contours of the cams are such that vacuum head 281 contacts hinge panel 93 of the box tray prior to the removal of the bearing plate such that vacuum contact is firmly made therewith. It is also to be understood that the invention does not preclude replacing the box closing mechanism just described by other box handling elements should a non-folded box be the desired end product.

The components of the matrix and the forming head are readily removable from their mounting points in order to accommodate boxes of other sizes and other configurations. Differing backup bars and compressors are necessary for boxes of differing depths. Also adjustments must be made for boxes of varying wall thickness. The basic inner matrix transverse and longitudinal dimensions must exceed the erected outside dimensions of the box by a small amount, say 0.030".

The stroke of the overfolding bender is adjusted to both the thickness and the type of material used for the box.

While various embodiments have been discussed and shown, the invention does not preclude extractors and closing elements other than those described for this specific embodiment illustrating the invention. Variations within the scope of the invention other than those disclosed will occur to those skilled in this particular art.

It is therefore desired that the invention be measured by the appended claims rather than by the illustrative disclosure made herein.

We claim:

1. Apparatus for forming a folded box from a blank having a hinge panel joining cover and receptacle sections, with each section having end and side flaps, and comprising means for forming the blank into a tray, means for joining the end and side flaps at the junctures thereof, tray folding elements, and means for grasping said formed tray at the hinge panel and carrying said tray into engagement with said folding elements to bend along said hinge panel said cover and receptacle sections to close said cover and receptacle sections to define a closed box.

2. Apparatus in accordance with claim 1 further comprising means for maintaining said cover and receptacle sections partly separated after bending, means for loading said receptacle section, and means for completing the bending together to close said cover section over said loaded receptacle section.

* * * * *